US010017359B2

(12) United States Patent
Eversole et al.

(10) Patent No.: US 10,017,359 B2
(45) Date of Patent: Jul. 10, 2018

(54) RACK AND ROLLER PINION LIFT SYSTEM

(71) Applicants: Nathan R Eversole, Tower Hill, IL (US); John R Loyet, Dunlap, IL (US); Bradley K Eversole, Tower Hill, IL (US)

(72) Inventors: Nathan R Eversole, Tower Hill, IL (US); John R Loyet, Dunlap, IL (US); Bradley K Eversole, Tower Hill, IL (US)

(73) Assignee: Modern Concepts Outdoors LLC, Tower Hill, IL (US)

( * ) Notice: Subject to any disclaimer, the term of this patent is extended or adjusted under 35 U.S.C. 154(b) by 310 days.

(21) Appl. No.: 14/150,694

(22) Filed: Jan. 8, 2014

(65) Prior Publication Data

US 2014/0124293 A1 May 8, 2014

(51) Int. Cl.

| | |
|---|---|
| ***B66B 11/04*** | (2006.01) |
| ***B66B 9/08*** | (2006.01) |
| ***B66F 3/02*** | (2006.01) |
| ***B66B 9/02*** | (2006.01) |
| *E06C 7/08* | (2006.01) |
| *E06C 7/12* | (2006.01) |
| *E06C 7/16* | (2006.01) |

(52) U.S. Cl.

CPC ..... *B66B 11/0461* (2013.01); *B66B 9/022* (2013.01); *B66B 9/0815* (2013.01); *B66F 3/02* (2013.01); *E06C 7/08* (2013.01); *E06C 7/12* (2013.01); *E06C 7/16* (2013.01)

(58) Field of Classification Search

CPC ... B66B 11/04; B66B 11/0423; B66B 11/043; B66B 11/0461; B66B 9/08; B66B 9/02; B66B 9/022; B66B 9/0815; B66F 3/00; B66F 3/02; B66F 3/04; E06C 7/08; E06C 7/12; E06C 7/16

See application file for complete search history.

(56) References Cited

U.S. PATENT DOCUMENTS

| | | | | | |
|---|---|---|---|---|---|
| 436,943 | A * | 9/1890 | Wilson | B66F 3/02 | 254/97 |
| 726,957 | A * | 5/1903 | Macey | E05D 15/582 | 109/70 |
| 768,821 | A * | 8/1904 | Schmick | B66F 3/02 | 254/97 |

(Continued)

*Primary Examiner* — Katherine W Mitchell
*Assistant Examiner* — Shiref M Mekhaeil
(74) *Attorney, Agent, or Firm* — Philip L. Bateman

(57) ABSTRACT

A lift system comprising an elongated rack and a roller pinion drive system. A preferred version has two parallel rack with plurality of rungs extending horizontally between the racks to form a ladder. A plurality of spaced apart mounting brackets are configured for affixing the ladder vertically to a stationary member, the stationary member not forming part of the invention. In this version, a drive unit retained within a carriage is mounted in proximity to the racks. The drive unit interacts with the racks to move the carriage upwardly and downwardly along the racks. A speed limiter is also disclosed that can be retained within the carriage below the drive unit and mounted in proximity to one of the racks. The speed limiter interacts with the rack to produce a breaking action if the drive unit fails, preventing the carriage to drop down quickly. Single rack and inclined rack versions are disclosed as alternatives.

5 Claims, 16 Drawing Sheets

(56) References Cited

U.S. PATENT DOCUMENTS 920,630 A * 5/1909 Ocumpaugh ..... B66B 9/022 187/271
1,392,078 A * 9/1921 Ouillett ..... B66B 9/02 187/271
1,559,418 A * 10/1925 Gilchrist ..... B66F 3/02 254/1
2,514,498 A * 7/1950 Kesler ..... B66B 9/022 187/270
3,001,629 A * 9/1961 Mimlitch ..... B41J 29/50 400/295
3,115,750 A * 12/1963 Cowles ..... F02C 9/28 137/115.07
3,157,551 A * 11/1964 Granozio ..... B31F 1/305 156/471
3,367,454 A * 2/1968 Scherer ..... F16F 9/486 16/51
3,548,970 A * 12/1970 Hutchens, Sr. ..... E04G 1/20 182/129
3,602,354 A * 8/1971 Theilen ..... B41J 29/50 400/351
3,645,245 A * 2/1972 Hammond ..... G05D 13/00 123/198 DB
3,762,777 A * 10/1973 Jacob ..... B66D 1/08 188/170
3,866,717 A * 2/1975 Johansson ..... B66B 9/022 187/270
4,269,285 A * 5/1981 Ohkoshi ..... B66F 9/02 187/244
4,294,332 A * 10/1981 Ready ..... E04G 1/20 182/132
4,588,048 A * 5/1986 Rodriguez ..... B66F 7/28 187/213
4,728,098 A * 3/1988 Shannon ..... A63G 1/12 188/292
4,877,236 A * 10/1989 Shannon ..... A63G 1/12 472/14
4,967,733 A * 11/1990 Rousseau ..... B66F 11/04 182/13
5,191,920 A * 3/1993 McGregor ..... B65B 43/59 141/114
5,310,018 A * 5/1994 Lahaie ..... E04G 1/20 182/113
5,558,181 A * 9/1996 Bundo ..... B66B 9/022 187/270
5,893,676 A * 4/1999 Yamamoto ..... B62D 1/184 403/321
5,979,875 A * 11/1999 Yocum ..... B66F 3/02 254/95
6,523,647 B2 * 2/2003 Duplessis ..... B66F 11/04 182/141
6,830,132 B1 * 12/2004 Kang ..... B66B 9/022 187/271
7,389,641 B2 * 6/2008 Ruppert ..... B60K 25/06 111/200
7,909,139 B2 * 3/2011 Blue ..... A01M 31/02 182/103
7,975,807 B2 * 7/2011 Franklin ..... B66B 9/027 182/144
8,534,422 B2 * 9/2013 Solhjem ..... B66F 11/04 182/141
8,616,388 B2 * 12/2013 Butler ..... A47B 43/00 108/106
2009/0266648 A1 * 10/2009 Bazterra ..... B66B 9/022 187/270
2011/0203877 A1 * 8/2011 Tiner ..... B66B 5/027 187/247
2011/0308893 A1 * 12/2011 Studer ..... B66B 9/022 187/270
2012/0048652 A1 * 3/2012 DiGiovanni ..... B66B 9/0846 187/201
2013/0031996 A1 * 2/2013 Imase ..... F16C 19/463 74/465
2014/0305742 A1 * 10/2014 Graf ..... B66B 9/187 187/239

* cited by examiner

RACK AND ROLLER PINION LIFT SYSTEM

BACKGROUND

Field

This invention relates generally to a lifting apparatus and specifically to a rack and roller pinion lift system.

Prior Art

Certain elevators apply a drive mechanism based on a rack and gear system, also referred to as rack and gear elevators. A motor mounted an elevator car drives a gear the teeth of which engage a wave crest type toothed rack (see FIGS. 15-16) secured to a wall of an elevator shaft. Drawbacks of wave crest rack and gear elevators include noise generated when the gear teeth move along the rack and relatively poor ride comfort. For these reasons, rack and gear elevators are typically used in areas when noise and ride comfort are not critical such as the building industry or other industrial applications. For example, a dual rack and gear drive and an integral I-beam rail and rack system can be used in outdoor broadcast towers.

Despite these drawbacks, a rack and gear elevator does not need a drive machine located in an overhead space or a machine room and does not need the expensive redundant pulleys and cables needed to assure backup safety typical of building elevators. However, a strong rack is needed, thus reducing cost savings. Further, a rack and gear elevator does not require a counterweight traveling along the elevator shaft and thus allows a smaller shaft or more passenger space in a given elevator shaft, but uses a large expensive gear and has to have a motor on the elevator carriage that may generate noise passengers would not like. Also the gear and rack engagement is adjacent the elevator and can generate additional noise passengers might not tolerate well in a typical office building. Such noise might accentuate any claustrophobia or other fears many people have of elevators. Rack and gear elevators, thus are not currently typically found in office buildings despite the clear advantage that they require less space than, for example, conventional traction elevators. For these reasons, rack and gear elevators are conventionally not considered suitable for non-industrial uses. I hope to change all that through improvements to both the rack and the gear using some out-of-the-box thinking.

SUMMARY

An first, preferred, exemplary embodiment provides a lift system comprising two elongated racks. A plurality of rungs extend horizontally between the racks to form a ladder with the racks parallel to each other, something that allows easier climbing and a ready attachment for safety equipment. A plurality of vertically spaced apart mounting brackets are provided for affixing the ladder vertically to a stationary object such as a wall, tower, pole or even tree. A drive unit retained within a carriage is mounted in proximity to the racks. The drive unit interacts with the racks to move the carriage upwardly and downwardly along the racks. A speed limiter is retained within the carriage below the drive unit and mounted in proximity to one of the racks. The speed limiter interacts with the rack to produce a slow descent if the drive unit fails, preventing the carriage from dropping down too quickly for safety. Roller pinions are provided to smooth the action and minimize friction and provide mechanical advantage for easy operation with minimal power requirements. In an alternative exemplary embodiment, a single rack is used and the rack is inclined rather than completely vertical, so the system can be commercially embodied in a stairway chair lift. Other examples are also noted.

The invention will be better understood by reference to the drawing and detailed description of exemplary embodiments.

DRAWINGS

The drawing includes 16 illustrative figures in order to satisfy best mode, enablement and written description requirements, and two alternative embodiments are shown as examples.

Figure 4:
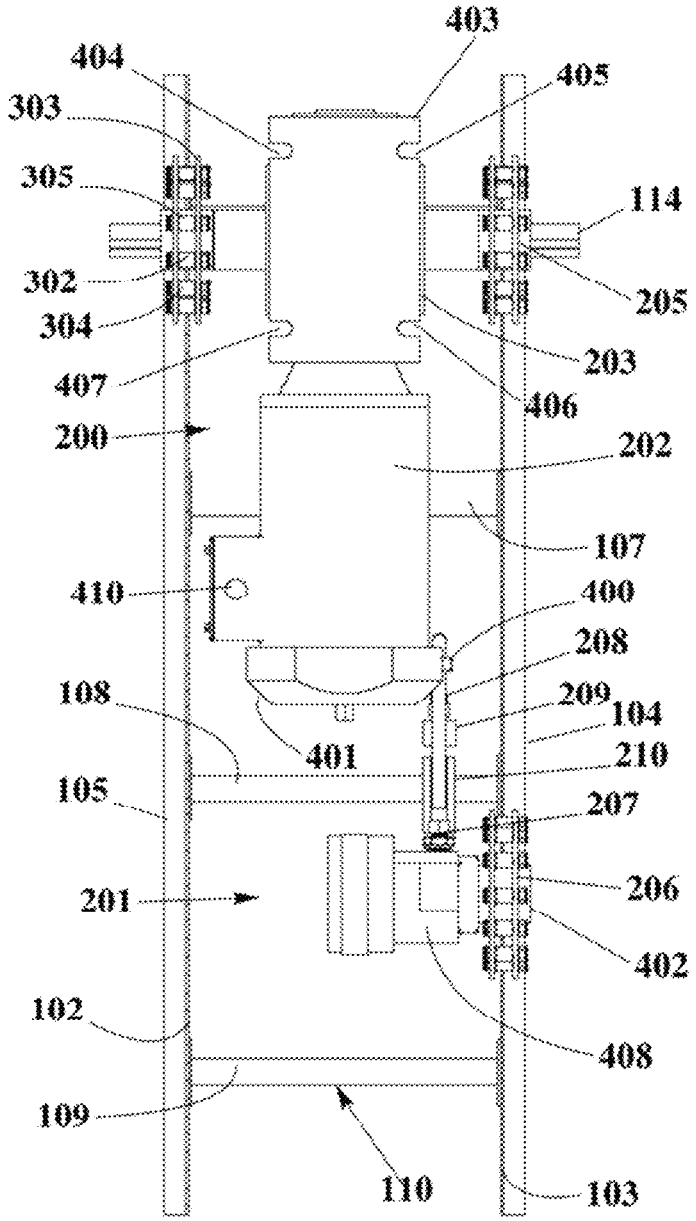
Figure 5:
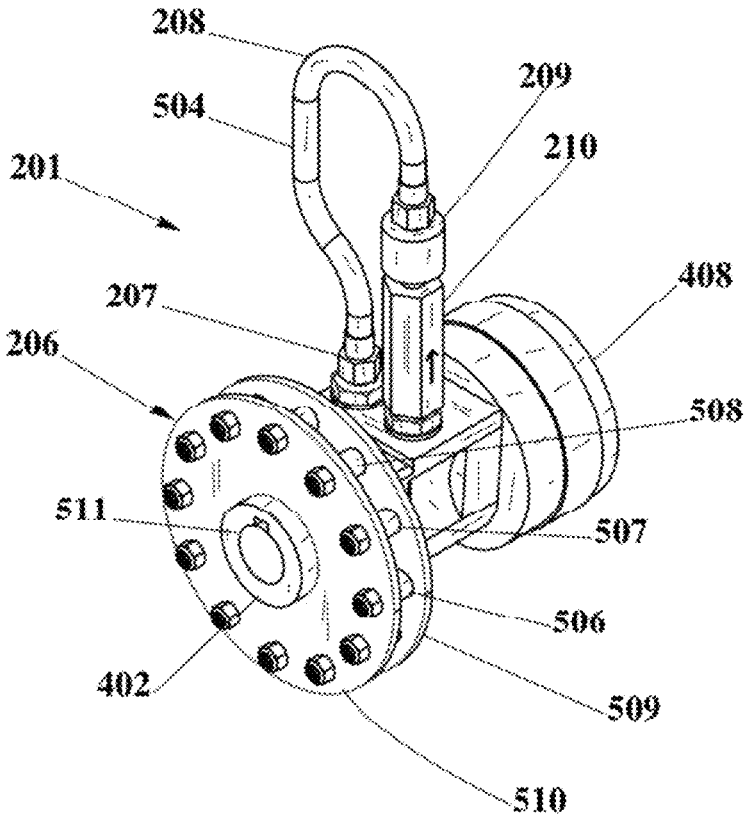
Figure 6:
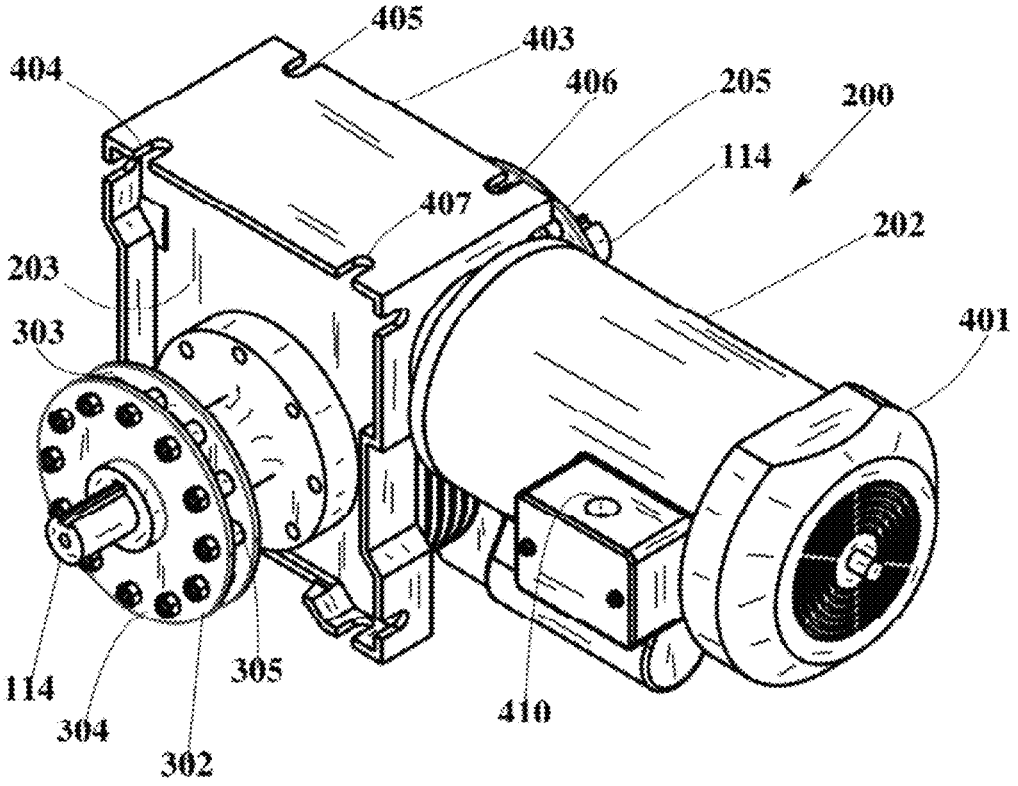
Figure 7:
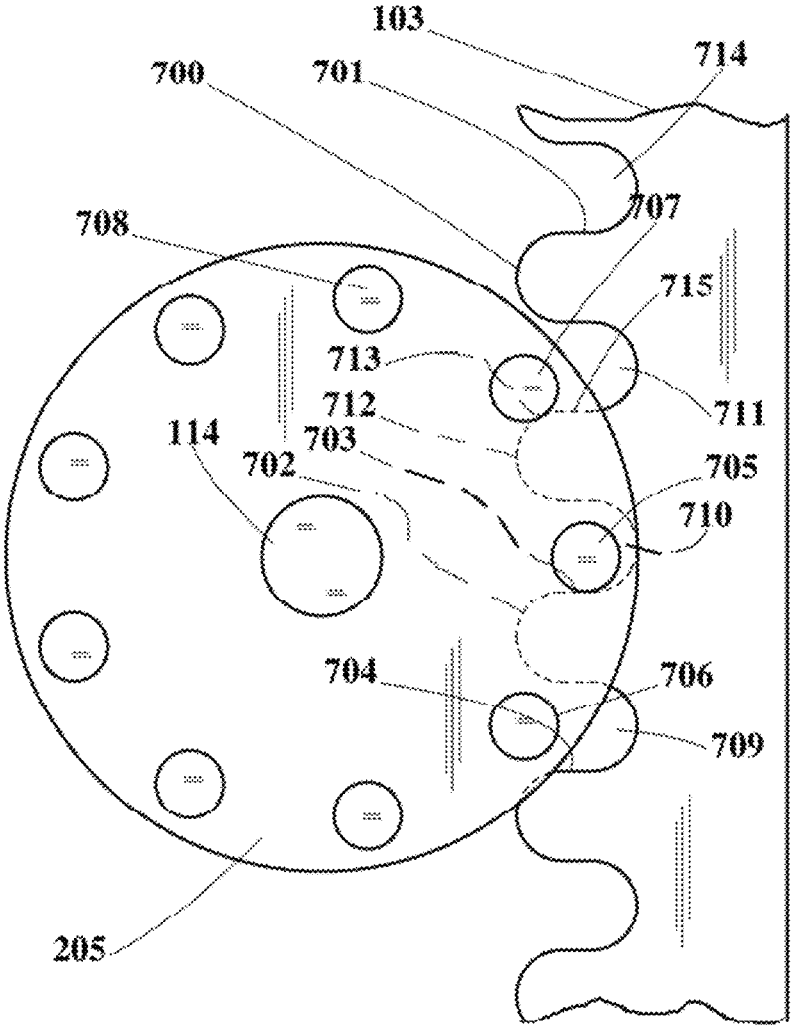
Figure 8:
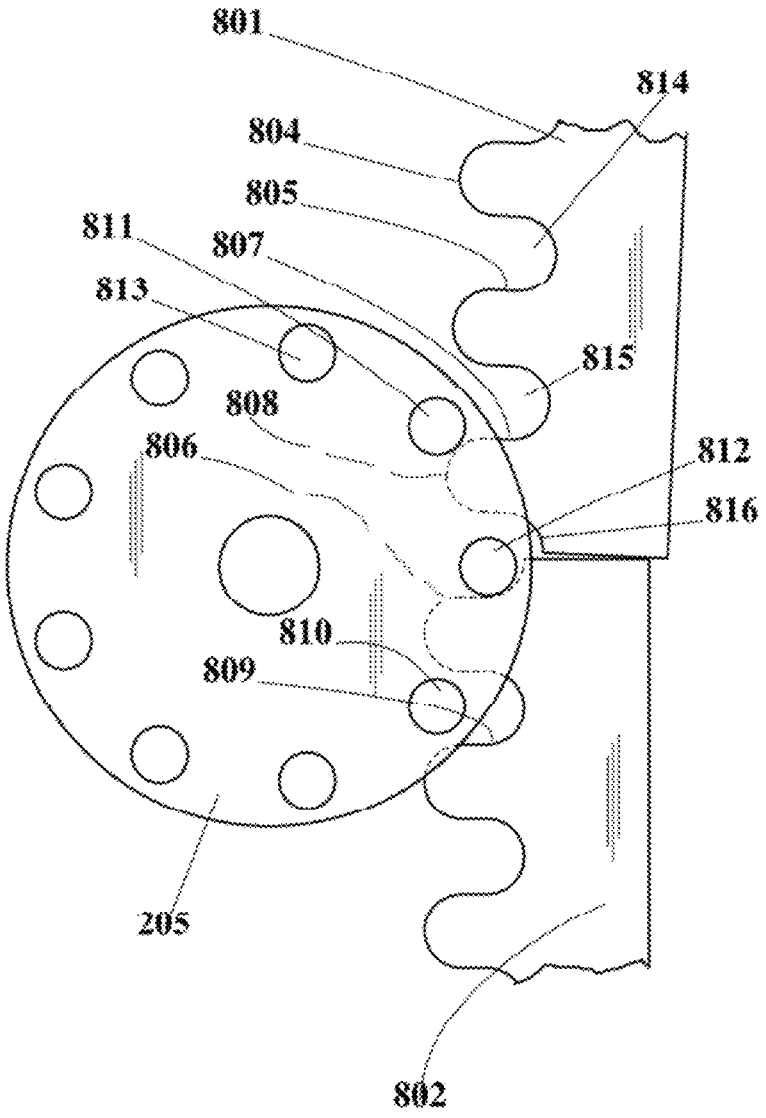
Figure 9:
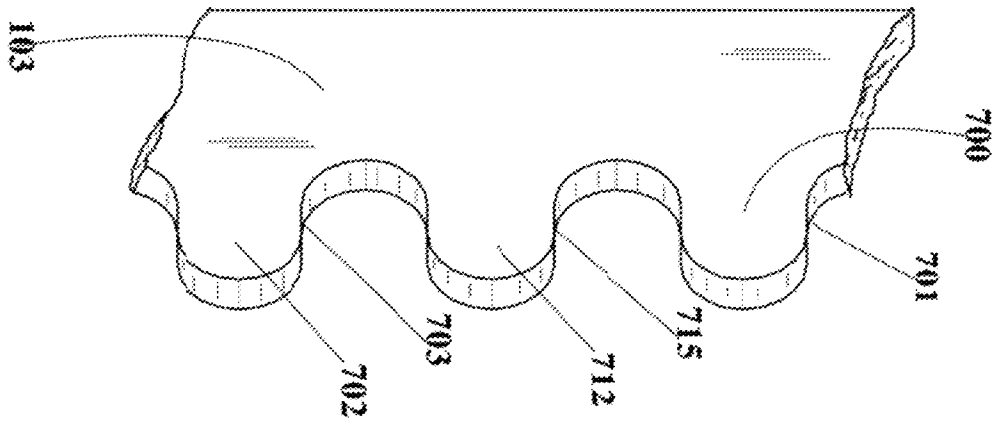
Figure 10:
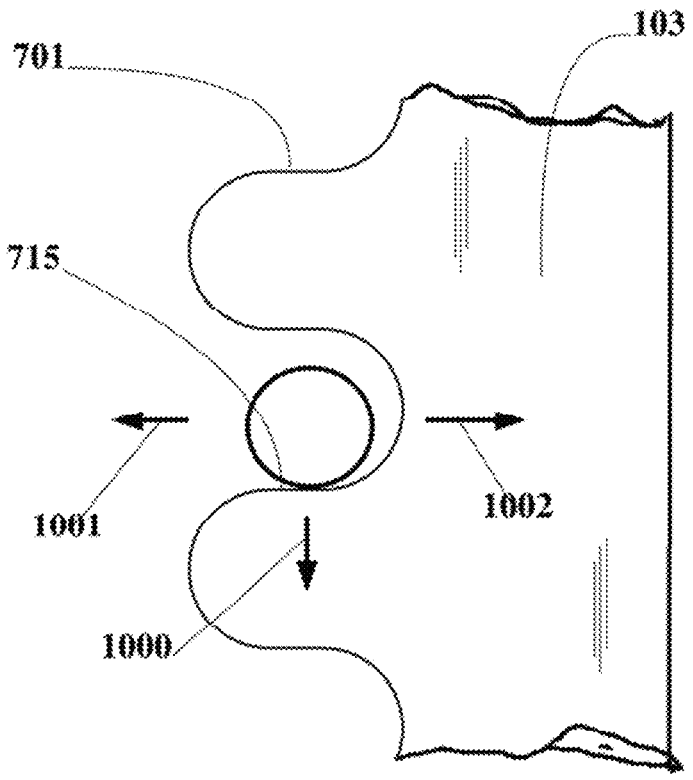
Figure 11:
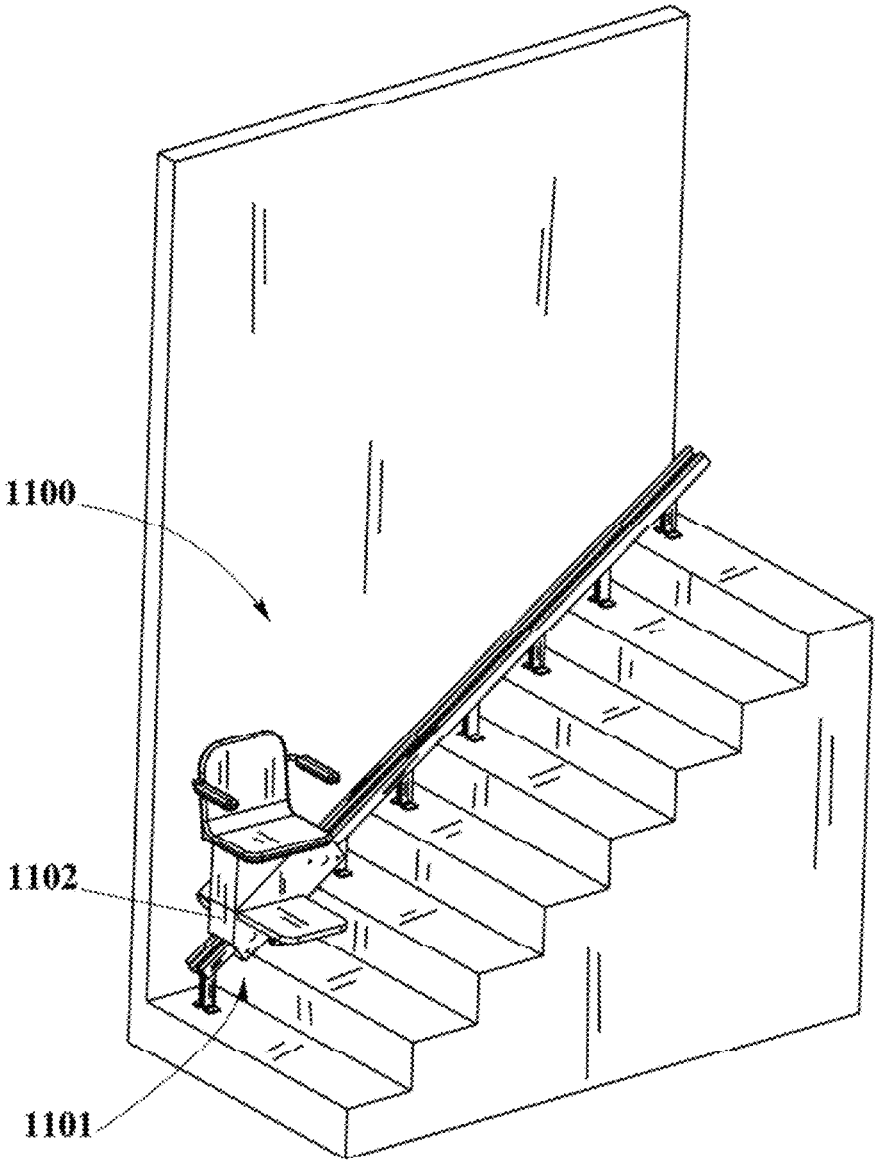
Figure 12:
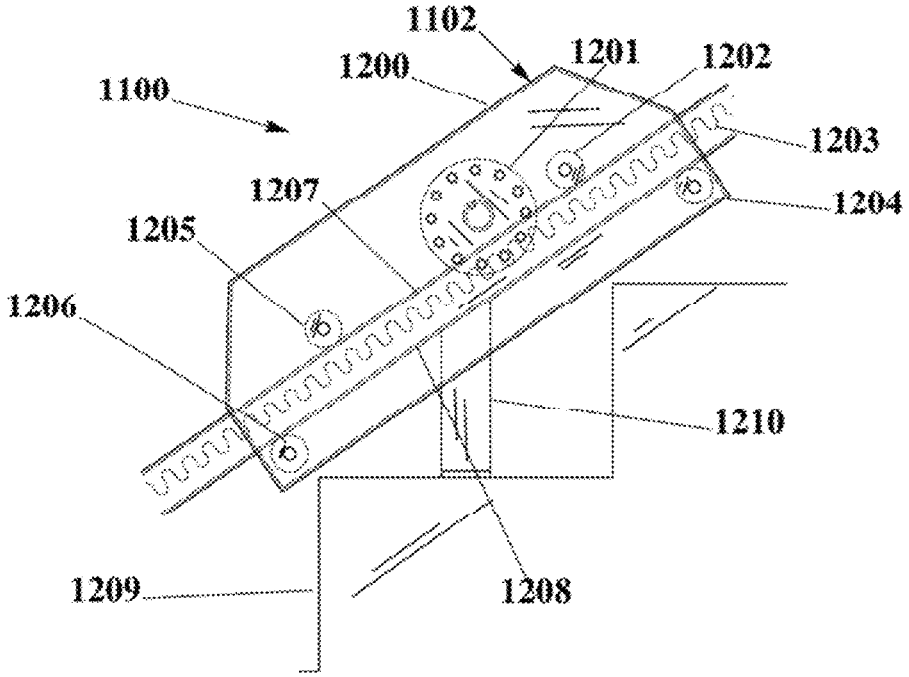
Figure 13:
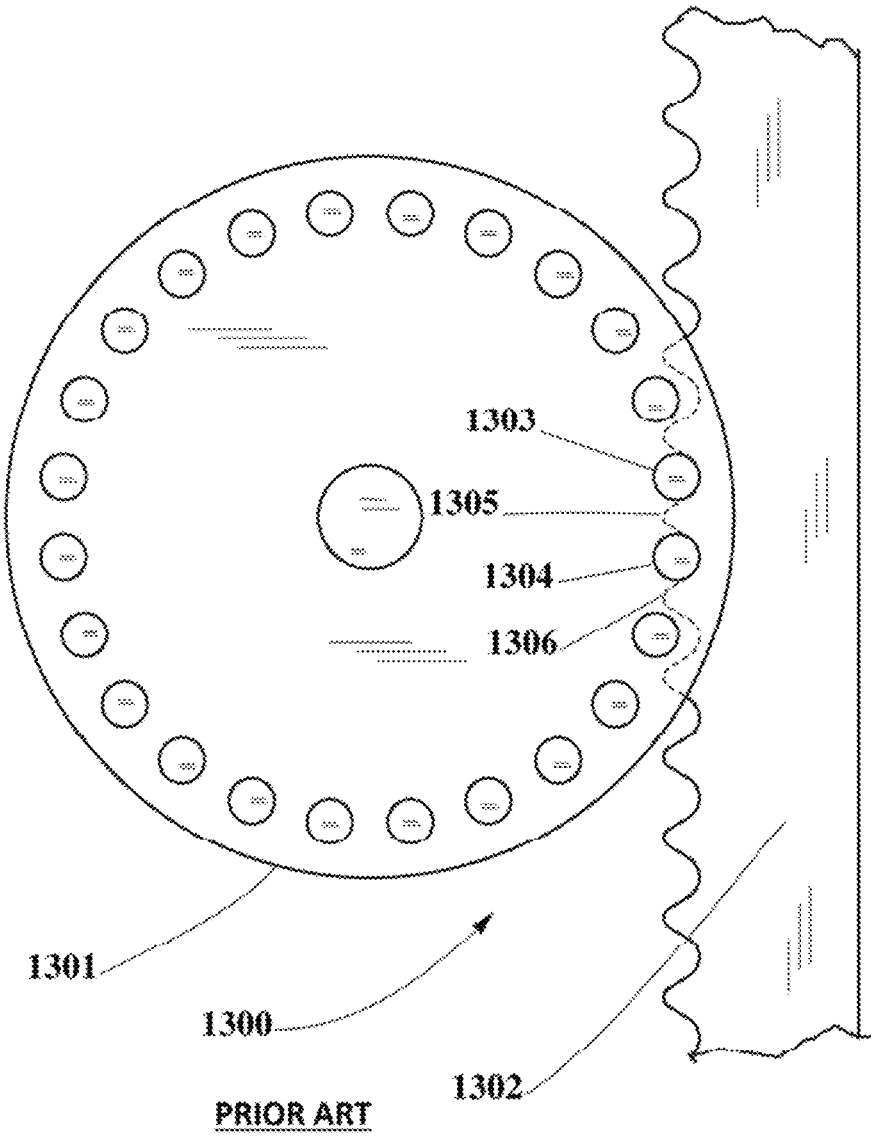
Figure 14:
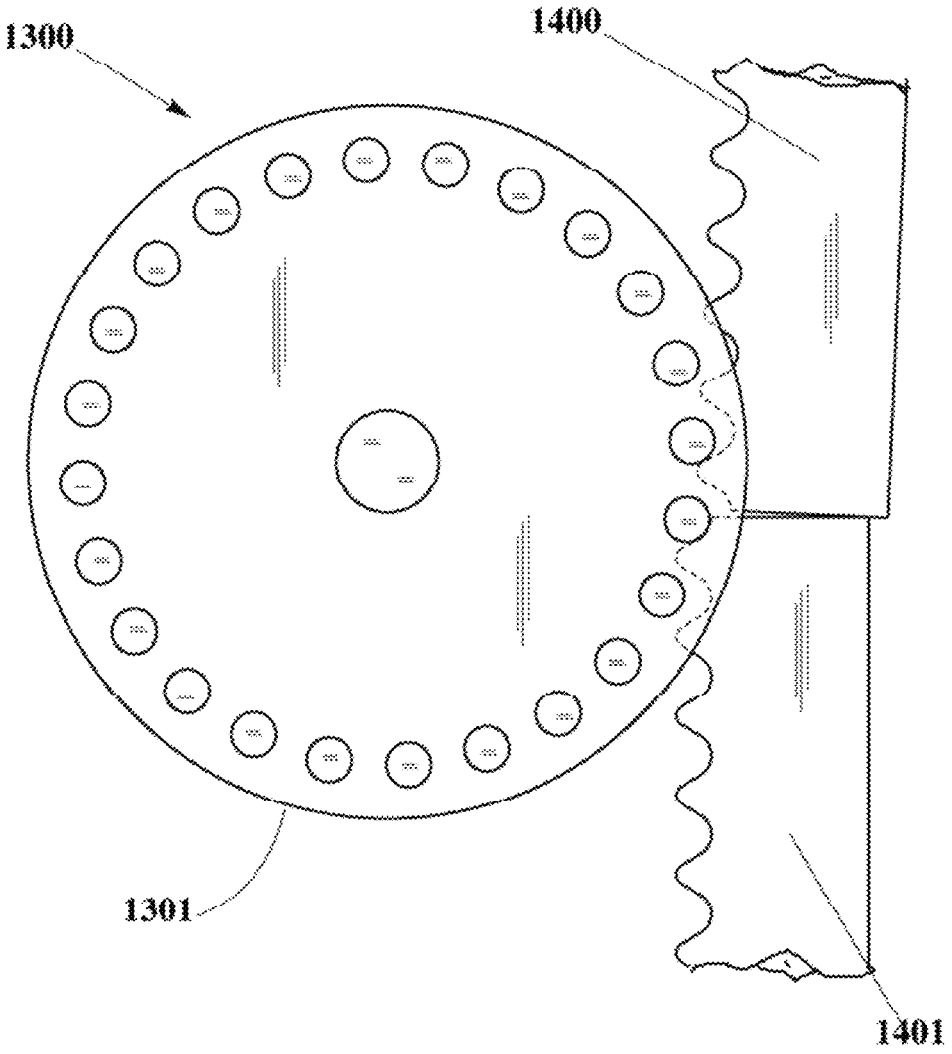
PRIOR ART FIG. 14
Figure 15:
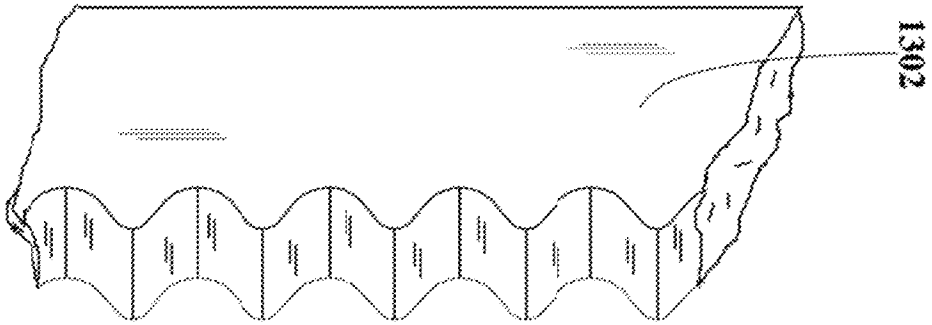
PRIOR ART FIG. 15
Figure 16:
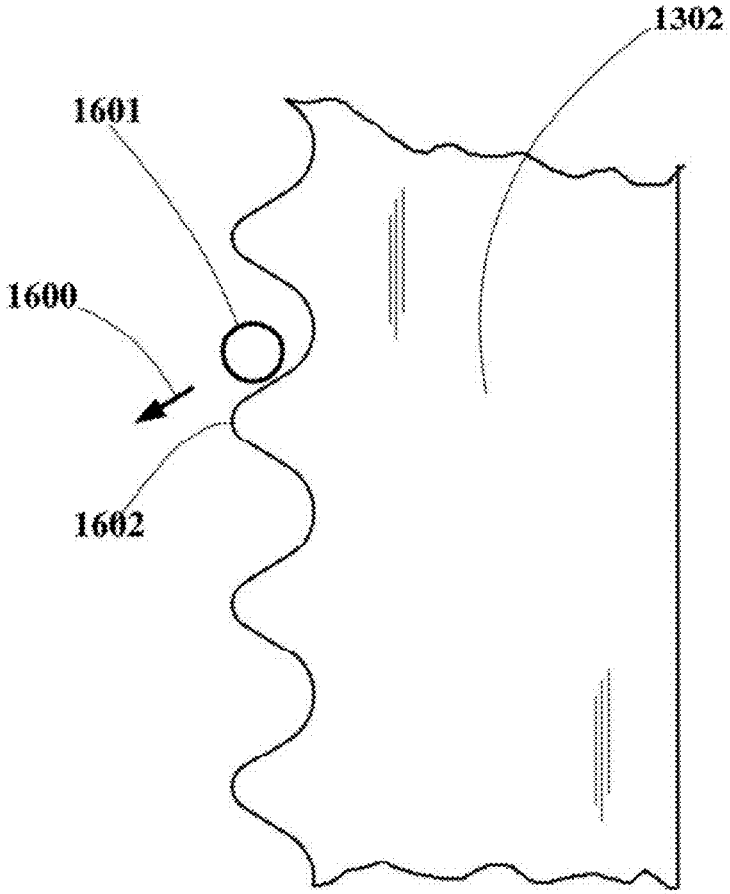
PRIOR ART FIG. 16

FIG. 4 is a front view of system 100 with carriage 101 removed to better show drive unit 200 and speed limiter 201;

FIG. 5 is a left upper rear perspective view of speed limiter 201;

FIG. 6 is a lower left front perspective view of drive unit 200;

FIG. 7 is a right side elevational view of pinion roller 205 and drive rack 103;

FIG. 8 is a right side elevational view to show how roller 205 adapts to misalignment of upper rack 801 to lower rack 802;

FIG. 9 is a left perspective view of rack 103;

FIG. 10 is a right side elevational view of rack 103;

FIG. 11 is a perspective view of an exemplary stairway chair lift 1100 with a single rack and roller pinion lift system 1101;

FIG. 12 is a right side diagrammatic cross sectional view of a carriage 1102 of lift system 1101;

FIG. 13 is a PRIOR ART right side elevational view of a roller pinion 1301 and rack 1302 for purposes of comparison with FIG. 7;

FIG. 14 is a PRIOR ART right side elevational view of roller 1301 and misaligned upper rack 1400 for purposes of comparison with FIG. 8;

FIG. 15 is a PRIOR ART left front perspective view of rack 1302 for purposes of comparison with FIG. 9; and FIG. 16 is a PRIOR ART right side elevational view of rack 1302 for purposes of comparison with FIG. 10.

DETAILED DESCRIPTION

First Exemplary Embodiment

Figure 1:
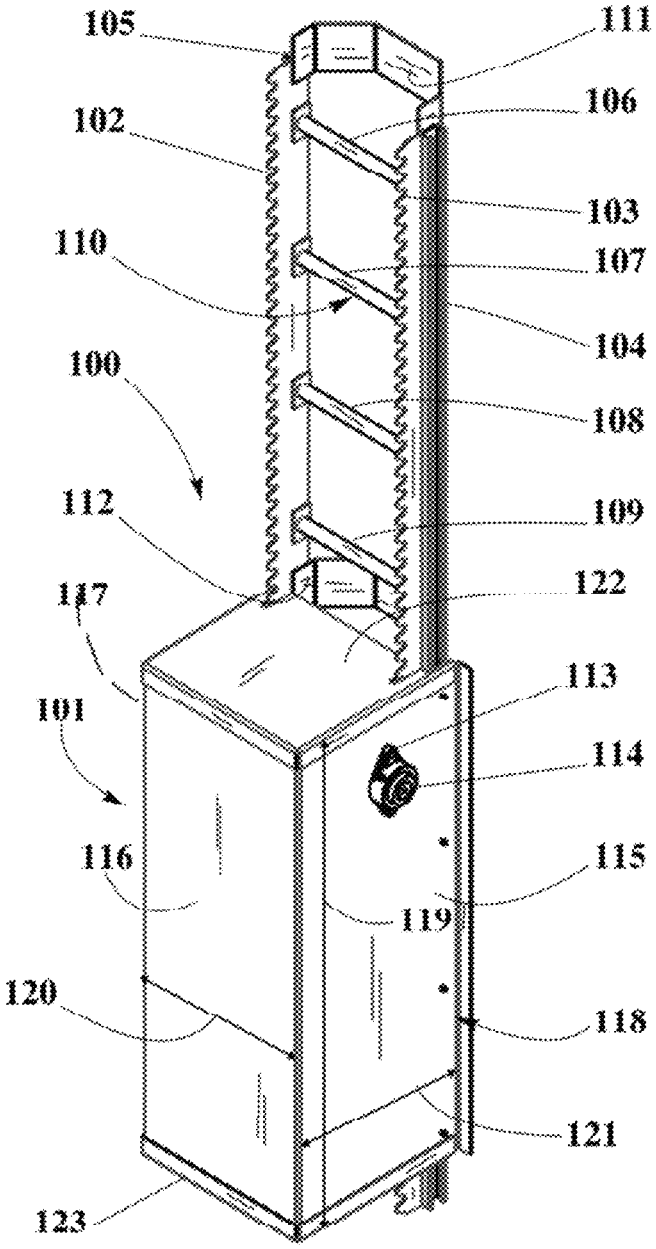
FIG. 1 is a right, upper front perspective view of a first exemplary rack and roller pinion lift system 100.

FIG. 1 is a right, upper front perspective view of a first exemplary rack and roller pinion lift system 100. System 100 can be used for a deer stand or elevator or cargo lift or other vertical lifting applications. System 100 comprises a carriage 101, a left rack 102, and a right rack 103. Carriage 101 consists of a rectangular boxlike housing 118 of a height 119 at least twice its width 120 or depth 121 with a right wall 115, a front wall 116, a left wall 117 (not shown but similar to right wall 115), an upper platform 122 and a floor 123. In a passenger elevator, it will be understood that platform 122 would be the floor of the passenger compartment and floor 123 would be a subfloor spaced below to provide room for housing 118. A right guide rail 104 is attached to a projects laterally outward from rack 103 and a left guide rail 105 projects laterally leftward and outward from rack 102. A rung 106, a rung 107, a rung 108, a rung 109 and several rungs (not shown) extend horizontally between rack 102 and rack 103 to form a ladder 110. An upper mounting bracket 111 a lower mounting bracket 112 are provided to mount ladder 110 to a vertical surface such as a tree or wall (not shown). A right mounting hub 113 and left mounting hub 301 (see FIG. 3) are provided for mounting a drive shaft 114 to carriage 101.

Figure 2:
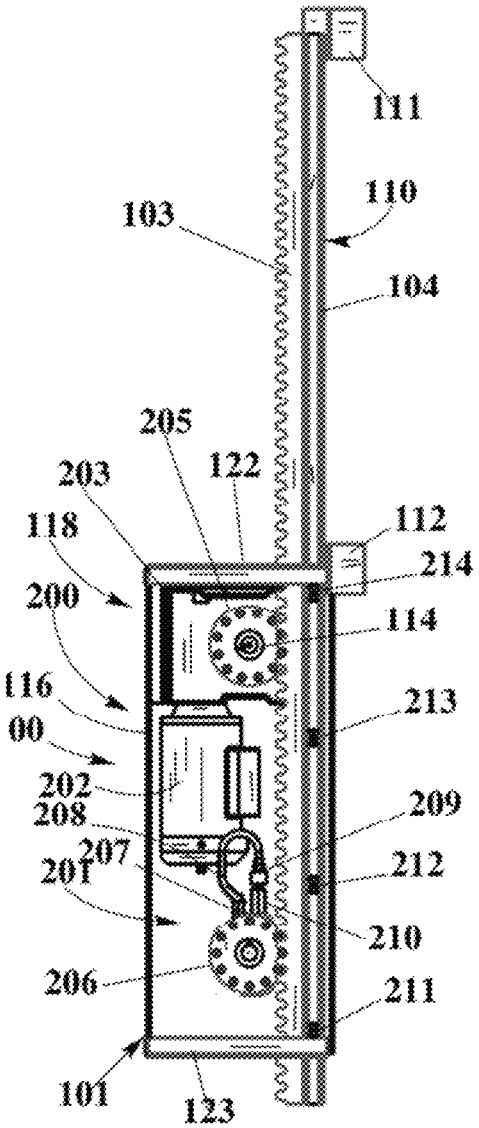
FIG. 2 is a right side elevational view in partial cross section of system 100.

FIG. 2 is a right side elevational view in partial cross section of system 100. Right wall 115 of carriage 101 is removed to better show a drive unit 200 and a speed limiter 201. Drive unit 200 comprises a motor 202, a gearbox or transmission 203, horizontal drive shaft 114, and a right roller pinion 205. Speed limiter 201 comprises a roller pinion 206, hydraulic pump 408 (see FIG. 4) a restriction tube 208, a first connector 207 and a second connector 210. Tube 208 has a fluid flow constrictor 209. Motor 202 has an electrical connector 410 (see FIG. 4) for attachment to a source of electric power such as a battery (not shown). A guide roller 211 is disposed within rail 104, and optionally also a guide roller 212, a guide roller 213 and a guide roller 214 to assure engagement of pinion 205 and pinion 206 with rack 103.

Figure 3:
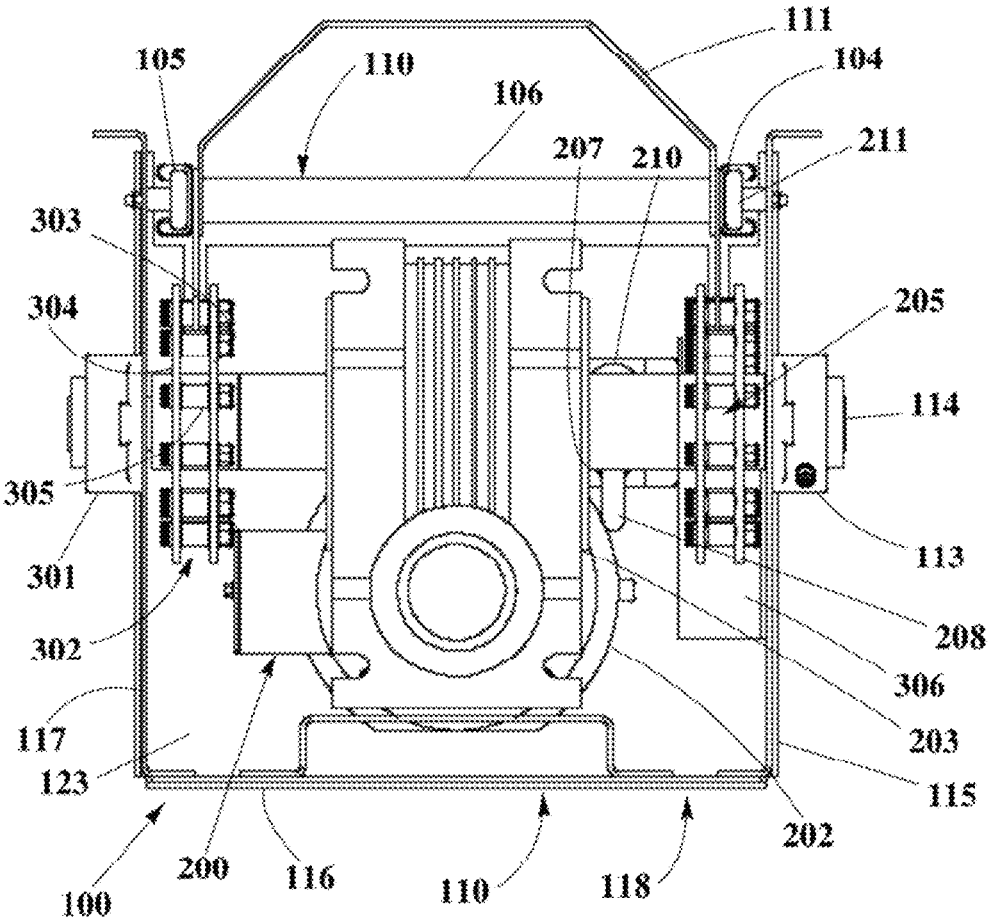
FIG. 3 is a top view of system 100 with platform 122 removed.

FIG. 3 is a top view of system 100 with platform 122 removed to better show right roller pinion 205 and a left roller pinion 302. A third roller pinion 206 (see FIG. 2) is below pinion 205. A mounting plate 306 is provided for attaching a hydraulic pump 408 (see FIG. 4) to wall 115. Roller pinion 302 comprises parallel vertical spaced right disc 303 and left disc 304 connected by a plurality of short rollers 305. Note that FIGS. 2-5 show roller pinion 205 with twelve rollers 305 and FIGS. 7 and 8 shows roller pinion 205 with only nine rollers 305. The number of rollers 305 is explained below with reference to FIGS. 7 and 8 below and is a significant departure from PRIOR ART roller pinion systems to reduce cost and power requirements for lift systems. A guide roller 211 is also disposed within rail 105.

FIG. 4 is a front view of system 100 with carriage 101 removed to better show drive unit 200 and speed limiter 201. Tube 208 is attached to bottom cap 401 of motor 202 by a bracket 400. A vertical mounting plate 403, attached to transmission 203, allows transmission 203 to be bolted to front wall 116, whit bolts (not shown) passing through notches 404-407 of plate 403. Roller pinion 206 is attached to wall 115 by a hub 402. Motor 202 contains an electrical connector 410 and speed limiter 201 contains an hydraulic pump 408.

FIG. 5 is a left upper rear perspective view of speed limiter 201, to better show pump 408, connector 210, constrictor 209, tube 208, attachment band 504, connector 505, rollers 506-508, right plate 509, left plate 510 and shaft 511 retained to hub 402.

FIG. 6 is a lower left front perspective view of drive unit 200;

FIG. 9 is a left perspective view of a small portion of rack 103 to better show rounded tooth 700 and horizontal flat upper surface 701. Tooth 712 is similar with horizontal flat upper surface 715. Likewise, tooth 702 has a horizontal flat upper surface 703. Flat surface 703 provides better support for pinion roller 705 (see FIG. 7) and less tendency for roller 705 to urge cage roller 205 outwardly off of rack 103 than prior art "wave crest" type racks such as rack 1302.

FIG. 10 is a right side elevational profile view of a portion of rack 103 to show the force balance on roller 705. Just as surface 701 is horizontal, so is surface 715. When roller 705 is in place resting on surface 715, all the force it exerts on rack 103 is essentially downward in the direction of arrow 1000 and there is essentially no outward force 1001 of inward force 1002 except such as might be applied by right roller 205 (not shown) in which roller 705 is captured as previously described. This is in stark contrast to the prior art wave crest rack 1302, which as seen in FIG. 16 necessarily always applies an outward force in the direction of arrow 1600 tending to pull roller 1601 out of engagement. This is quite important when one realizes that roller 1601 will normally be free rotating. Added lateral restraints are needed and usually extra safety mechanisms for such a "wave crest" system. That makes for noisy clattering operation and tends to put added pressure on tip 1602, which is pointed and not nearly as strong as the rounded design of tooth 700. So, to fight that, multiple teeth are usually engaged (as seen in FIG. 13.) Engagement of multiple teeth (two, tooth 1303 and tooth 1304 are shown engaged in FIG. 13 even though more might be needed) is used in prior art "wave crest" designs to spread the force to multiple tips (i.e. tip 1305 and 1306 rather than just tip 1305), since some play is required to account for minor misalignments, which play accentuates the tip breakage problem with the prior art systems. So, "wave crest" design makes for more failure due to breakage of teeth, which in turn requires a much thicker (horizontally) tooth such as seen by comparing FIG. 15 and FIG. 9. When considering that a building elevator might require a pair of racks the full height of the building, this is no minor consideration. Racks are not cheap, but optimization can reduce that cost as I have done. Since tooth 700 is much more substantial in the vertical direction, strength is enhanced and tip breakage is much, much less likely so the rack can be quite thin. This is particularly true where the application is in the form of a dual rack ladder with rungs holding the racks in position. The ladder also gives a ready means of ascent for rescue and repair purposes. In short, system 100 is optimized for vertical applications and thus is a major breakthrough and advance in the art that should allow the advantages of roller pinion drive without the drawbacks. This is because rack 1302 is a "wave crest" type rack designed for horizontal not vertical orientations. In a horizontal orientation (envision FIG. 16 rotated clockwise 90 degrees), all the weight of on roller 1601 would be applied toward the right in FIG. 16, thus forcing roller 1601 into engagement with rack 1302. But when rack 1302, designed for horizontal use, is rotated vertical it is dysfunctional for roller pinions. Now, if instead of roller 1601 a gear (not shown) with teeth matching the teeth of rack 1302, the tendency remains.

Operation of First Exemplary Embodiment

FIG. 7 is a right side elevational view of roller pinion 205 and drive rack 103. To show operation rack 103 contains a rounded tooth 700 with horizontal upper surface 701, rounded tooth 702 with horizontal upper surface 703, while load bearing roller 705 on surface 703 in recess 710, exiting roller 706 rises from surface 704 exiting recess 709, and entering roller 707 contacts tooth 712 at point 713 and rolls easily into recess 711 to continue process by supporting load as roller 705 exits recess 710 and roller 708 contacts tooth 700 and rolls onto surface 701 of recess 714. One roller bears the weight so that the other rollers can easily enter and leave under less weight.

FIG. 8 is a right side elevational view to show how roller 205 adapts to misalignment of upper rack 801 to lower rack 802. As with FIG. 7 described is tooth 804, upper surface 805, upper surface 806, upper surface 807, entrance point 808 for roller 811 into recess 815 while roller 812 on surface 806 is in misaligned recess 816, as roller 810 leaves surface 809, with roller 813 next up and set to enter recess 814 to rest on surface 805

FIG. 13 is a PRIOR ART right side elevational view of a wave crest type similar to that shown in US Patent No. roller pinion system 1300. Roller pinion 1301 and rack 1302 are shown for purposes of comparison with FIG. 7. Note large disc size with multiple rollers contact and load always on a slope. System 1300 is designed for horizontal application, not vertical. In contrast we provide a transverse surface with a rounded tooth so we have a much smaller roller pinion 205, fewer rollers, much stronger rollers, much stronger teeth, more rounded teeth, so rack 103 can be thinner.

FIG. 14 is a PRIOR ART right side elevational view of roller pinion 1301, misaligned rack 1400 and rack 1401 for purposes of comparison with FIG. 8. Note pressure on thin tips of sharp teeth leading to breakage of tips and inability to climb.

FIG. 15 is a left front perspective view of rack 1302 for purposes of comparison with FIG. 9. Rack 1302 has to be much thicker to handle load due to thin wave crests.

FIG. 16 is a right side elevational view of rack 1302 for purposes of comparison with FIG. 10

Alternative Embodiment

FIG. 11 and FIG. 12 show an alternate embodiment as exemplary of a single inclined system 1101. With system 1101 a single rack, single drive roller and a non-vertical system oriented at an incline for a stairway chair lift application is seen as within the scope of the invention. The system retains much of the advantage of the vertical system due to the rack configuration.

FIG. 11 is a perspective view of an exemplary stairway chair lift 1100, with a single rack and roller pinion lift system 1101 having a carriage 1102.

FIG. 12 is a right side diagrammatic cross sectional view of carriage 1102 of lift system 1100 having a housing 1200 covering and roller pinion 1201. System 1100 comprises a rack 1203 with an upper surface 1207 and a lower surface 1208 mounted by a bracket 1210 to a stairway 1209. An upper front guide roller 1202, an upper rear guide roller 1205, a lower front guide roller 1204 and a lower rear guide roller 1206 are provided.

Conclusion, Considerations, and Coverage

Accordingly the reader will see that, according to the invention, I have provided a lift system that does not require as much power as convention lift systems, whether vertical or inclined or horizontal and allows reduced rack thickness due to racks with relatively flat upper surfaces and much larger teeth. This also allows reduced roller pinion size and allows better handling of misalignments. For example it has been found that a standard 18 V rechargeable power drill can operate a deer stand using this system.

While the above description contains many specifics, these are not limitations on the scope of the invention, but rather exemplifications of the various embodiments thereof. Many other embodiments are possible within the teachings of the invention. For example, FIG. 1 could be easily adapted to elevator applications using either single or dual or multiple racks, funiculars of any size or weight or width, stairway chair lifts, vertical or inclined boat launchers or lifts, vertical of inclined cargo lifts, exterior building lifts, construction elevators and lifts, window washing lifts, all with reduced power requirements.

Thus coverage in the claims below should be determined by the claims and their legal equivalents, and not limited to the examples given.

The invention claimed is:

1. A rack and roller pinion lift system comprising:
(a) at least one elongated vertical rack having a plurality of rounded teeth, adjacent teeth being separated by a rounded recess and each tooth having a rounded end and a substantially horizontal upper surface; and
(b) a carriage that moves up and down along the rack at a speed, the carriage comprising:
(i) a housing for holding a load;
(ii) a lifting roller pinion assembly connected to the housing and comprising a plurality of rollers arranged in a circular array, the rollers being transverse to the rack, the rollers being sequentially engaged with the rack as the carriage moves up and down along the rack; two vertically spaced apart plates that are perpendicular to the rollers and between which the rollers extend; and a central drive shaft engaging and extending between the plates;
(iii) a motor and gearbox communicating with the central drive shaft of the lifting roller pinion assembly for rotating the central drive shaft and the plates;
(iv) a safety roller pinion assembly connected to the housing and comprising a plurality of rollers arranged in a circular array, the rollers being transverse to the rack, the rollers being sequentially engaged with the rack as the carriage moves up and down along the rack; two vertically spaced apart plates that are perpendicular to the rollers and between which the rollers extend; and a safety assembly drive shaft engaging and extending between the plates that rotates in two directions; and
(v) a hydraulic pump assembly communicating with the safety assembly drive shaft of the safety roller pinion assembly for limiting rotational speed of the safety assembly drive shaft in one direction, the hydraulic pump assembly comprising a hydraulic pump with an inlet, an outlet, and a conduit communicating with the inlet and outlet through which a hydraulic fluid flows as the drive shaft rotates, the conduit having a one-way flow control check valve that allows unrestricted flow of the hydraulic fluid from the inlet to the outlet and that limits flow of the hydraulic fluid from the outlet to the inlet, such that the rotational speed of the safety assembly drive shaft is limited in one direction, and such that the speed at which the carriage moves in one direction along the rack is limited.

2. The rack and pinion lift system of claim 1 wherein the system comprises two racks.

3. The rack and pinion lift system of claim 2 additionally comprising a plurality of rungs extending between the racks.

4. The rack and pinion lift system of claim 1 wherein the lifting roller pinion assembly has nine to twelve rollers.

5. A rack and roller pinion lift system comprising:
(a) at least one elongated rack defining an axis having a plurality of rounded teeth, adjacent teeth being separated by a rounded recess and each tooth having a rounded end and an upper surface substantially perpendicular to the axis of the rack; and
(b) a carriage that moves along the rack at a speed, the carriage comprising:
(i) a housing for holding a load;
(ii) a lifting roller pinion assembly connected to the housing and comprising a plurality of rollers arranged in a circular array, the rollers being transverse to the rack, the rollers being sequentially engaged with the rack as the carriage moves along the rack; two spaced apart plates that are perpendicular to the rollers and between which the rollers extend; and a central drive shaft engaging and extending between the plates;

(iii) a motor and gearbox communicating with the central drive shaft of the lifting roller pinion assembly for rotating the central drive shaft and the plates;

(iv) a safety roller pinion assembly connected to the housing and comprising a plurality of rollers arranged in a circular array, the rollers being transverse to the rack, the rollers being sequentially engaged with the rack as the carriage moves along the rack; two spaced apart plates that are perpendicular to the rollers and between which the rollers extend; and a safety assembly drive shaft engaging and extending between the plates; and (v) a hydraulic pump assembly communicating with the safety assembly drive shaft of the safety roller pinion assembly for limiting rotational speed of the safety assembly drive shaft in one direction, the assembly comprising a hydraulic pump with an inlet, an outlet, and a conduit communicating with the inlet and outlet through which a hydraulic fluid flows as the drive shaft rotates, the conduit having a one-way flow control check valve that allows unrestricted flow of the hydraulic fluid from the inlet to the outlet and that limits flow of the hydraulic fluid from the outlet to the inlet, such that the rotational speed of the safety assembly drive shaft is limited in one direction, and such that the speed at which the carriage moves in one direction along the rack is limited.

* * * * *